US008050604B2

(12) United States Patent
Tominaga

(10) Patent No.: US 8,050,604 B2
(45) Date of Patent: Nov. 1, 2011

(54) BELT MEMBER AND IMAGE FORMING APPARATUS USING THE BELT MEMBER

(75) Inventor: Hiroshi Tominaga, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 625 days.

(21) Appl. No.: 12/204,254

(22) Filed: Sep. 4, 2008

(65) Prior Publication Data

US 2009/0067895 A1 Mar. 12, 2009

(30) Foreign Application Priority Data

Sep. 7, 2007 (JP) ..... 2007-232921

(51) Int. Cl.
*G03G 15/01* (2006.01)

(52) U.S. Cl. ..... 399/302; 399/303

(58) Field of Classification Search ..... 399/302, 399/303, 308
See application file for complete search history.

(56) References Cited

U.S. PATENT DOCUMENTS

| | | | | |
|---|---|---|---|---|
| 5,633,702 | A | 5/1997 | Hayashi et al. | |
| 6,352,750 | B1 | 3/2002 | Kanetake | |
| 2006/0285871 | A1* | 12/2006 | Kato et al. | 399/99 |
| 2007/0020450 | A1 | 1/2007 | Kitamura et al. | |
| 2007/0282051 | A1* | 12/2007 | Okano | 524/495 |

FOREIGN PATENT DOCUMENTS

| | | |
|---|---|---|
| JP | 8-278708 | 10/1996 |
| JP | 2000-56585 | 2/2000 |
| JP | 2000-330390 | 11/2000 |
| JP | 2001-47451 | 2/2001 |
| JP | 2001-356570 A | 12/2001 |
| JP | 2002-53677 | 2/2002 |
| JP | 2002-56587 | 2/2002 |
| JP | 2005-112942 | 4/2005 |
| JP | 2006-69046 | 3/2006 |

* cited by examiner

*Primary Examiner* — David Gray
*Assistant Examiner* — Rodney Bonnette
(74) *Attorney, Agent, or Firm* — Fitzpatrick, Cella, Harper & Scinto

(57) ABSTRACT

A belt member is rotatably extended around a plurality of rotatable members of an image forming apparatus for forming a toner image on a recording material by using a developer containing a magnetic carrier. The belt member includes a layer, formed of a crystalline resin material, having an outer peripheral surface and an inner peripheral surface. The layer has a hardness of 0.25 GPa or more and 0.40 GPa or less at the outer peripheral surface and a hardness of 0.10 GPa or more and 0.20 GPa or less at the inner peripheral surface.

19 Claims, 7 Drawing Sheets

BELT MEMBER AND IMAGE FORMING APPARATUS USING THE BELT MEMBER

FIELD OF THE INVENTION AND RELATED ART

The present invention relates to an image forming apparatus such as a printer, a copying machine, a facsimile machine, or a multi-function machine. More specifically, the present invention relates to a belt member for use in the image forming apparatus and an image forming apparatus using the belt member.

As the image forming apparatus, there are white/black, monochromatic, or full color image forming apparatuses including electrophotographic copying machines, printers, and other various recording machines. For example, there is an image forming apparatus in which a plurality of image forming stations is provided along an intermediary transfer belt and an image is formed on a recording material (Japanese Laid Open Patent Application (JP A) 2001-356570 A). In such an image forming apparatus, in each of the image forming stations, a toner image on a photosensitive drum is primary transferred onto an intermediary transfer member (intermediary transfer belt) at a primary transfer portion by a primary transfer member to which a primary transfer voltage is applied. A plurality of toner images primary transferred from the plurality of image forming stations is collectively secondary transferred onto the recording material. A belt member such as the intermediary transfer belt travels while being stretched around a contact member such as a stretching roller and the like. For this reason, the belt member requires durability and on the other hand, it is necessary to prevent wearing by the contact member.

In order to improve the durability and an anti-wearing property, various belt members including a belt member using a resin material having a high Young's modulus such as polyimide as disclosed in JP-A 2001-047451 and JP-A 2002-053677, a belt member using a crystalline resin material such as polyether ether ketone or polyphenylene sulfide as disclosed in JP-A 2005-112942 and JP-A 2006-069046, and a belt member having a multi-layer structure of a base layer material as disclosed in JP-A 2000-56585, JP-A Hei 08-278708, and JP-A 2000-330390 have been proposed.

To the belt member, a transfer voltage is applied in an image forming step or various mechanical or electrical external forces are applied in such a manner that a cleaning member for cleaning a (front) surface of the belt member contacts the belt member. The belt member is required to further improve a mechanical strength, the anti-wearing property or a durable characteristic against the external force such as electrical durability.

Particularly, in an image forming apparatus using a two component developer, a magnetic carrier is somewhat deposited on a photosensitive drum together with toner when the toner is subjected to development on the photosensitive drum, so that during transfer, scratches occur on the belt member by the magnetic carrier deposited on the photosensitive drum. As a result, there arises such a problem that the scratches adversely affect an image characteristic or a cleaning property. For that reason, it is necessary to enhance the anti-wearing property (performance) of the surface of the belt member.

On the other hand, the belt member is required to satisfy an anti-folding property while being subjected to stress, in the neighborhood of an end portion, of a contact member such as a stretching roller or subjected to bending stress by the stretching roller.

In order to satisfy such two characteristics, as the belt member, the resin material having a high Young's modulus, i.e., high mechanical strength, such as polyimide has been used as described above but such a resin material itself is expensive. Further, in the case where an inexpensive resin material is used for the belt member, the resin material involves a serious problem with respect to the anti-wearing property. By providing a hard coating surface layer on a surface of material having low surface hardness, it is possible to compatibly realize the anti-wearing property and the durability. However, in the case of such a two-layer structure, it is necessary to perform a step of providing the surface layer. Therefore, even when a general-purpose resin material is used, the resultant belt member is expensive.

SUMMARY OF THE INVENTION

A principal object of the present invention is to provide a belt member excellent in anti-folding property and anti-wearing property.

Another object of the present invention is to provide an image forming apparatus using the belt member.

According to an aspect of the present invention is to provide a belt member to be rotatably extended around a plurality of rotatable members of an image forming apparatus for forming a toner image on a recording material by using a developer containing a magnetic carrier, the belt member comprising:

a layer, formed of a crystalline resin material, having an outer peripheral surface and an inner peripheral surface, wherein the layer has a hardness of 0.25 GPa or more and 0.40 GPa or less at the outer peripheral surface and a hardness of 0.10 GPa or more and 0.20 GPa or less at the inner peripheral surface.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, several embodiments of the present invention will be described in detail with reference to the drawings.

The present invention is capable of being carried out also in other embodiments in which a part or all of constitutions of the respective embodiments are replaced by their alternative constitutions so long as a belt member, of a crystalline resin material, such as an intermediary transfer belt or a recording material conveyer belt has a front surface (outer peripheral surface) at which a degree of crystallinity of the crystalline resin material is higher than that at a rear surface (inner peripheral surface).

Therefore, the present invention can be carried out in not only a tandem type image forming apparatus in which a plurality of photosensitive drums is disposed along a recording material conveyer belt or an intermediary transfer belt but also a single drum type image forming apparatus in which a single photosensitive drum is disposed.

In the following embodiments, only a principal portion concerning formation/transfer of a toner image will be described but the present invention can be carried out in various uses including printers, various printing machines, copying machines, facsimile machines, multi-function machines, and so on by adding necessary equipment, options, or casing structures.

First Embodiment

Figure 1:
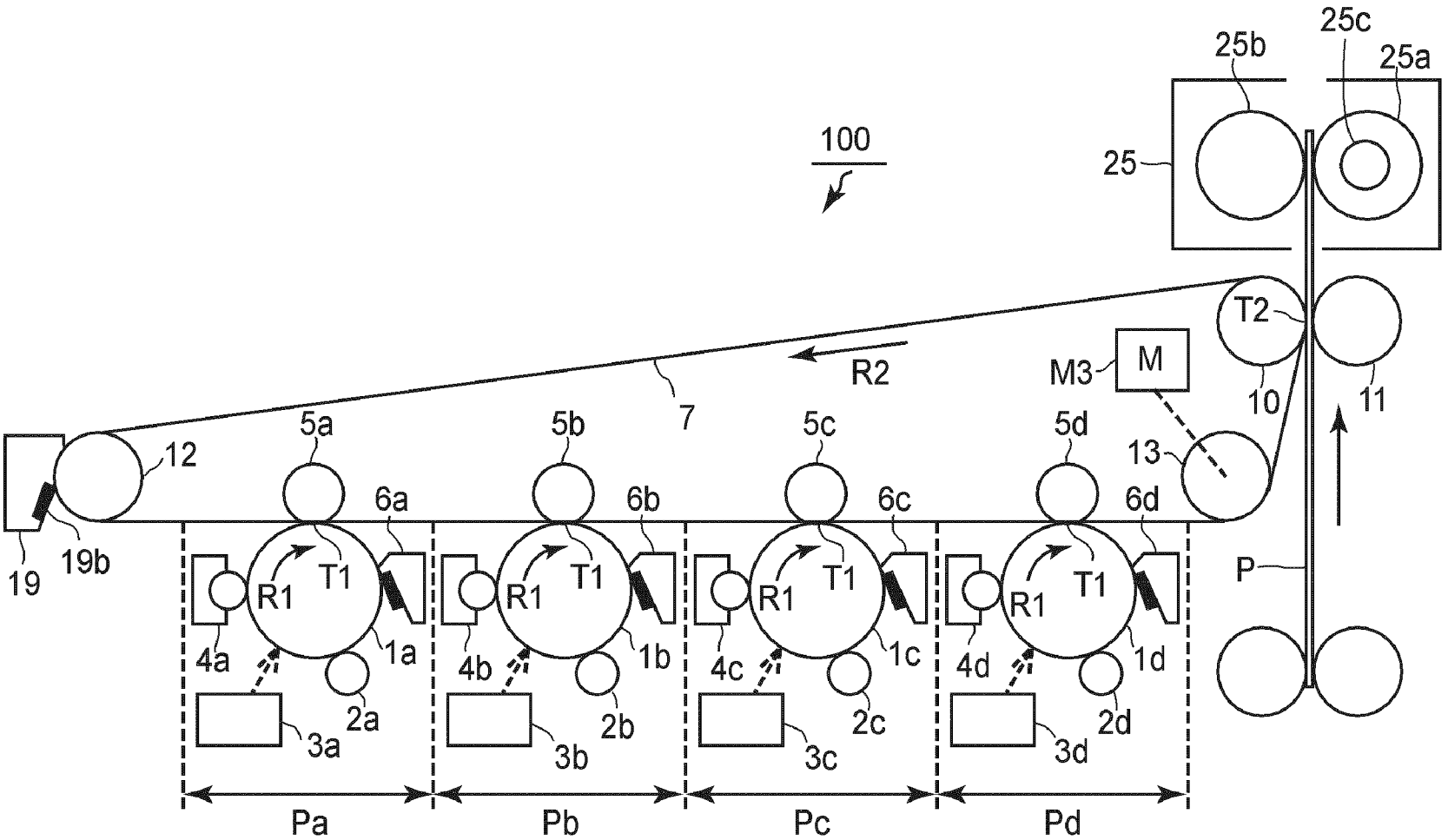
FIG. 1 is a schematic view for illustrating a structure of an electrophotographic image forming apparatus of First Embodiment.
Figure 2:
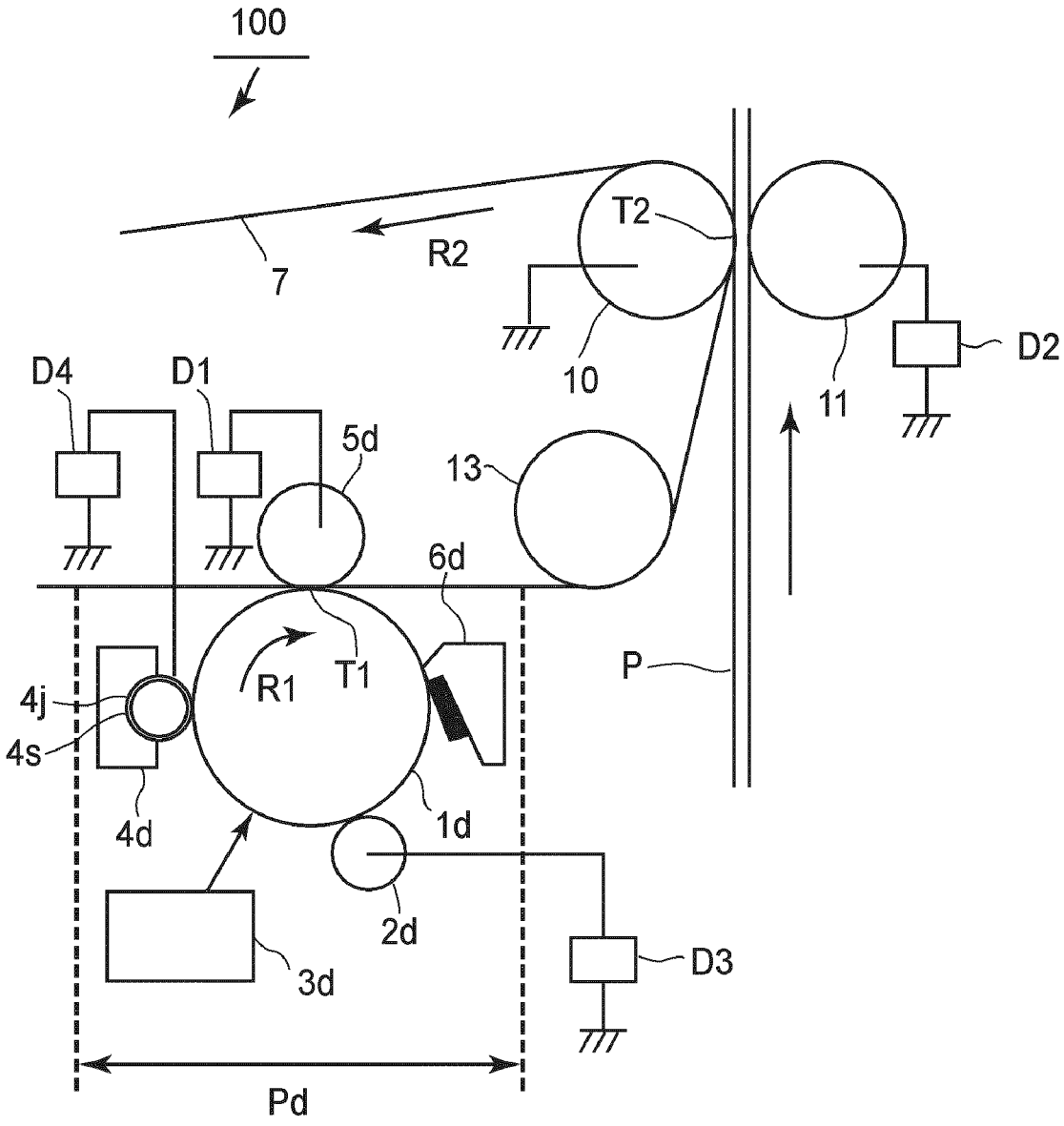
FIG. 2 is a schematic view for illustrating structures of an image forming station and a secondary transfer portion.

FIG. 1 is a schematic view for illustrating a structure of an electrophotographic image forming apparatus of First Embodiment and FIG. 2 is a schematic view for illustrating structures of an image forming station and a secondary transfer portion.

As shown in FIG. 1, an image forming apparatus 100 of First Embodiment is a tandem-type full-color printer in which four image forming stations Pa, Pb, Pc and Pd are arranged in a linear section of an intermediary transfer belt 7 as a belt member. Specifically, the full-color printer used in this embodiment is a laser beam printer ("LBP5900", mfd. by Canon, Inc.).

In the image forming station Pa, a yellow toner image is formed on a photosensitive drum 1*a* as an image bearing member and then is primary-transferred onto the intermediary transfer belt 7 which rotates and is formed in an endless shape. In the image forming station Pb, a magenta toner image is formed on a photosensitive drum 1*b* and is primary-transferred onto the yellow toner image on the intermediary transfer belt 7 in a superposition manner. In the image forming stations Pc and Pd, a cyan toner image and a black toner image are formed on photosensitive drums 1*c* and 1*d*, respectively, and are successively primary-transferred onto the magenta toner image on the intermediary transfer belt 7 in the superposition manner similarly as in the case of the image forming station Pb.

The four color toner images primary-transferred on the intermediary transfer belt 7 are conveyed to a secondary transfer portion T2, at which the toner images are collectively secondary-transferred onto a recording material P. The four color toner images secondary-transferred on the recording material P at the secondary transfer portion T2 are fixed by a fixing device 25 under application of heat and pressure. Thereafter, the recording material P is discharged to the outside of the image forming apparatus 100.

The fixing device 25 is constituted by pressing a pressing roller 25*b* against a heating roller 25*a* in which a halogen heater 25*c* is disposed. The fixing device 25 fixes the toner images carried on the recording material P on the surface of the recording material P.

The image forming stations Pa, Pb, Pc and Pd have substantially the same constitution except that the colors of toners of yellow for a developing device 4*a* provided in the image forming station Pa, magenta for a developing device 4*b* provided in the image forming station Pb, cyan for a developing device 4*c* provided in the image forming station Pc, and black for a developing device 4*d* provided in the image forming station Pd are different from each other. In the following description, the image forming station Pd will be described and with respect to other image forming stations Pa, Pb and Pc, the suffix d of reference numerals (symbols) for representing constituent members (means) is to be read as a, b and c, respectively, for explanation of associated ones of the constituent members.

As shown in FIG. 2, the image forming station Pd includes the photosensitive drum 1*d* as an example of the image bearing member. Around the photosensitive drum 1*d*, a charging device 2*d*, an exposure device 3*d*, the developing device 4*d*, a primary transfer roller 5*d*, and a cleaning device 6*d* are disposed in the image forming station Pd.

The photosensitive drum 1*d* is prepared by forming a layer of an organic photoconductor (OPC) consisting of an organic photosensitive member material having a negative charge polarity on an outer peripheral surface of an aluminum-made cylinder. The photosensitive drum 1*d* is rotated in a direction of an arrow R1 at a process speed of approximately 150 mm/sec by distributing a driving force supplied from a driving motor (M3 in FIG. 1).

The charging device 2*d* presses a charging roller against the photosensitive drum 1*d* with a predetermined pressure, so that the charging roller is rotated by the rotation of the photosensitive drum 1*d*. A power source D3 applies to the charging roller a superposed charging voltage consisting of a DC voltage and an AC voltage.

The exposure device 3*d* writes (forms) an electrostatic image for an image on the charged surface of the photosensitive drum 1*d* by scanning of the charged surface through a rotating mirror with a laser beam obtained by ON/OFF modulation of scanning line image data expanded from a separated color image for black.

The developing device stirs a two component developer obtained by mixing non-magnetic toner with a magnetic carrier, so that the toner is electrically charged negatively. The charged toner is carried on a surface of a developing sleeve 4*s* with a chain thereof created by a magnetic force of a fixed magnetic pole 4*j*, thus rubbing against the photosensitive drum 1*d*. The developing sleeve 4*s* rotates around the fixed magnetic pole 4*j* in a direction opposite from the rotational direction of the photosensitive drum 1 at their contact position.

The toner contains a negatively chargeable polyester resin material as a main component and has a volume-average particle size of 6.2 μm. The magnetic carrier is a resinous magnetic carrier having a volume-average particle size of 35 μm.

A power source D4 applies to the developing sleeve 4*s* a developing voltage in the form of a DC voltage biased (superposed) with an AC voltage, so that the toner is moved to the electrostatic image, on the photosensitive drum 1*d*, having a positive polarity relative to that of developing sleeve 4*s*. As a result, the electrostatic image is reversely developed.

The primary transfer roller 5*d* is urged by springs at both end portions thereof to sandwich the intermediary transfer belt 7 between the primary transfer roller 5*d* and the photosensitive drum 1*d* with a total load of 8N, thus forming a primary transfer portion T1 between the photosensitive drum 1*d* and the intermediary transfer belt 7. The primary transfer roller 5*d* is constituted by forming a semiconductive polyurethane foamed rubber layer on an outer peripheral surface of a metal core and has an ASKER-C hardness of 10 and a roller resistance of $1\times10^6\Omega$.

A power source D1 applies a positive DC voltage to the primary transfer roller 5*d*, so that the toner image negatively charged and carried on the photosensitive drum 1*d* is moved to the intermediary transfer belt 7 passing through the primary transfer portion T1.

The cleaning device 6*d* rubs the photosensitive drum 1*d* with a cleaning blade to remove transfer residual toner which passed through the primary transfer portion T1 and remains on the surface of the photosensitive drum 1*d*.

As shown in FIG. 1, a secondary transfer roller 11 presses the intermediary transfer belt 7 against a back-up roller 10 to form the secondary transfer portion T2 between the intermediary transfer belt 7 and the secondary transfer roller 11. During a process in which the recording material P is nipped and conveyed through the secondary transfer portion in superposition with the toner image on the intermediary transfer belt 7, the toner image is moved from the intermediary transfer belt to the recording material P.

The secondary transfer roller 11 is prepared by forming a foamed rubber layer of NBR rubber and hydrin rubber, which are a semiconductor material as a main component, on a metal core. The resultant semiconductor roller member has an ASKER-C hardness of 35 and a roller resistance of $1\times10^8\Omega$.

The back-up roller 10 is formed of a stainless steel-made cylindrical material and is connected to ground potential.

A power source D2 applies a positive constant voltage to the secondary transfer roller 11 to cause a transfer current to pass through a series circuit created by the back-up roller 10, the intermediary transfer belt 7, the recording material P, and the secondary transfer roller 11. A part of the transfer current passes through a toner deposited portion of the intermediary transfer belt 7, thus contributing to the movement of the toner from the intermediary transfer belt 7 to the recording material P.

A cleaning device 19 includes a 2 mm-thick polyurethane cleaning blade 19*b* end of which is abutted against the surface of the intermediary transfer belt 7 so that an extending direction of the blade 19*b* toward the intermediary transfer belt 7 is opposite from the rotational direction of the intermediary transfer belt 7 at the abutting position. The cleaning device 19 rubs and removes transfer residual toner or the like, which passed through the secondary transfer portion T2 without being transferred, with the cleaning blade 19*b*.

<Belt Member>

As shown in FIG. 1, the endless intermediary transfer belt 7 as the example of the belt member is extended and supported by a driving roller 13, the back-up roller 10, and a tension roller 12 which are examples of a rotatable member. The intermediary transfer belt 7 is driven by a driving motor M3 to rotate in a direction of an arrow R2.

Figure 5:
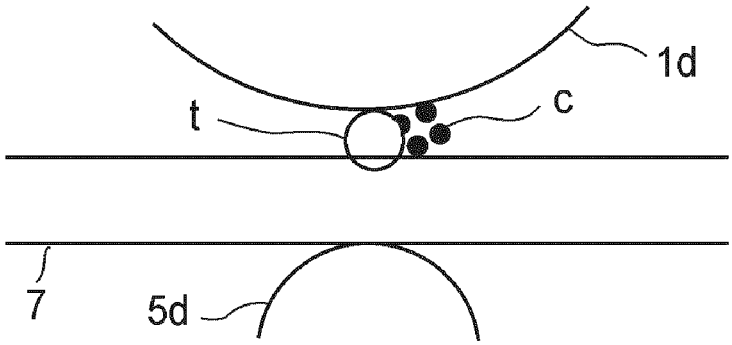
FIG. 5 is a schematic view for illustrating damage on an intermediary transfer belt by a magnetic carrier.

As shown in FIG. 5, when the electrostatic image on the photosensitive drum 1*d* is developed with the developer carried on the developing sleeve 4*s*, a part of the magnetic carrier (c) contained in the developer is deposited on the photosensitive drum 1 together with the toner (t) in some cases.

Referring to FIG. 5, the magnetic carrier c carried on the photosensitive drum 1*d* together with the toner t can form a scratch by being subjected to rubbing of the surface of the intermediary transfer belt 7 when the toner image is transferred from the photosensitive drum 1*d* on the intermediary transfer belt 7. Such a scratch leads to transfer non-uniformity to lower an image quality and lowers a cleaning property of the intermediary transfer belt 7.

Therefore, the intermediary transfer belt 7 is required to select a material therefor having a surface hardness and an anti-wearing property (anti-folding property) which cause no large scratch even when the magnetic carrier c is dragged during high-speed rotation.

Figure 6:
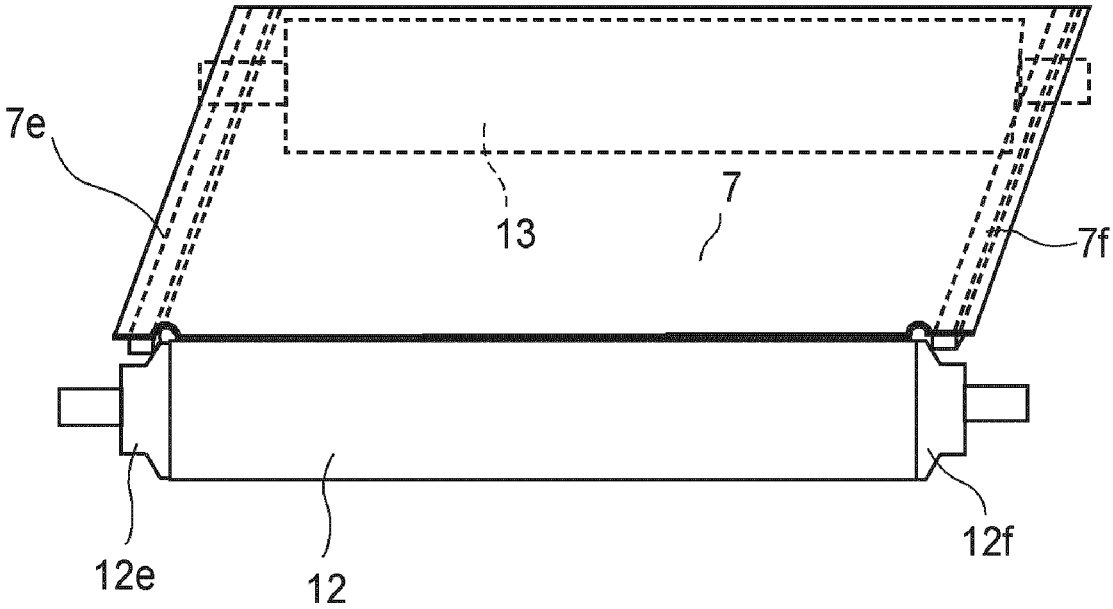
FIG. 6 is a schematic view for illustrating ribs for controlling lateral deviation of the intermediary transfer belt.

As shown in FIG. 6, at both end portions of a rotation shaft of the tension roller 12, rollers 12*e* and 12*f* formed of a polyacetal resin material are rotatably inserted in order to control lateral deviation occurring when the intermediary transfer belt 7 is driven by the driving roller 13.

For this reason, during the high-speed rotation of the intermediary transfer belt 7, portions of the intermediary transfer belt 7 contacting the rollers 12*e* and 12*f* are moved and protruded in a lateral direction of the intermediary transfer belt 7, so that the intermediary transfer belt 7 is repeatedly folded (bent) and deformed with a small radius.

To both edge portions of the inner peripheral surface of the intermediary transfer belt 7 formed in a layer and a seamless shape, inwardly projected ribs for limiting movement of the intermediary transfer belt 7 in a rotational axis direction of the intermediary transfer belt 7 are provided so as to extend continuously along a full circumference of the intermediary transfer belt 7. The ribs 7*e* and 7*f* are formed of an urethane rubber having a JIS-A hardness of 70 in a width of 5 mm and a thickness of 1 mm and are bonded to the inner peripheral surface of the intermediary transfer belt 7 continuously along the full circumference of the intermediary transfer belt 7.

For this purpose, the ribs 7*e* and 7*f* are formed of a sufficiently soft material within a range satisfying the anti-wearing property (performance) but in a boundary area in which the ribs 7*e* and 7*f* are provided, a difference in flexing resistance is caused during the high-speed rotation of the intermediary transfer belt 7, so that the ribs 7*e* and 7*f* are subjected to weak stress concentration.

Accordingly, it is necessary to select a material, for the intermediary transfer belt 7, capable of exhibiting a sufficient anti-fatigue property while resisting bending stress repetitively generated in the boundary area, in which the ribs 7*e* and 7*f* are bonded, during the high-speed rotation of the intermediary transfer belt 7.

Further, when the material is erroneously selected, in the case where the intermediary transfer belt 7 is operated for a long time in a low temperature environment, a crack (breakage) can occur in the boundary area in which the ribs 7*e* and 7*f* are bonded.

As the material for the intermediary transfer belt 7, the polyimide resin material which is a thermosetting resin material has been conventionally employed. However, the material itself is expensive and, in addition, is poor in processing property and productivity, thus resulting in increased cost of parts.

For this reason, with respect to a model of the image forming apparatus which is less used and a small number of sheets to be processed and do not need to have durability comparable to that of the polyimide resin material, it has been proposed that a hard coating surface layer is provided on a surface of a thermoplastic resin material having a lower surface hardness.

However, in that case, a step of providing the surface layer is required, so that even when a general-purpose resin material is used, the resultant intermediary transfer belt is expensive comparably to the cost of the single-layer constitution of the polyimide resin material.

In these circumstances, the present inventor has developed an intermediary transfer belt which is formed in a layer of a thermoplastic resin material and is capable of compatibly realizing the anti-fatigue property, the anti-flexing property, and the anti-wearing property by devising a processing step. The present inventor has provided the intermediary transfer belt 7 increased in only degree of surface crystallinity by using a crystalline thermoplastic resin material. By using a polyether ether ketone (PEEK) resin material, the degree of crystallinity is adjusted, so that an intermediary transfer belt 7 having a surface hardness of 0.25 GPa or more at a front surface thereof and a surface hardness of 0.20 GPa or less at a rear surface thereof.

In the present invention, as the material usable for the belt member, it is possible to use any thermoplastic crystalline resin material. For example, polyether ether ketone, polyphenylene sulfide, polybutylene terephthalate, and the like may be suitably used.

Further, to these resin materials, for the purpose of imparting electroconductivity, at least one species of organic or inorganic fine powder may be added. As the inorganic fine powder, it is possible to use inorganic spherical fine particles such as carbon black power, magnesium oxide powder, magnesium fluoride powder, silicon oxide powder, aluminum oxide powder, boron nitride powder, aluminum nitride powder, and titanium oxide powder. The fine powder to be added may preferably be spherical and may preferably have a particle size of 1.0 μm or less in order to retain surface smoothness of the resin material to which the fine powder is added.

The kind, the particle size and the content of such fine powder to be added are not particularly limited so long as the fine powder can impart the above-described electroconductivity to a base layer. However, a total amount of the addition of such fine powders may preferably be about 5-40 wt. %, particularly 5-25 wt. %, on the basis of a base resin material.

Consequently, the following effects are achieved.

(1) The resultant belt member has a sufficient durability against various external forces with respect to the mechanical strength, the anti-wearing property, and the anti-flexing and fatigue properties.

(2) By increasing only the degree of surface crystallinity, the resultant surface hardness is increased to a predetermined value or more, so that an occurrence of damage of the belt member by the contact member can be prevented and it is possible to retain a good cleaning property.

(3) The belt member of the present invention is less costly than a belt formed of the polyimide resin material conventionally used principally as the intermediary transfer belt material and a multi-layer belt.

<Production Process of Belt Member>

A production process of the belt member including the following steps (1) to (5) will be described.

Figure 3:
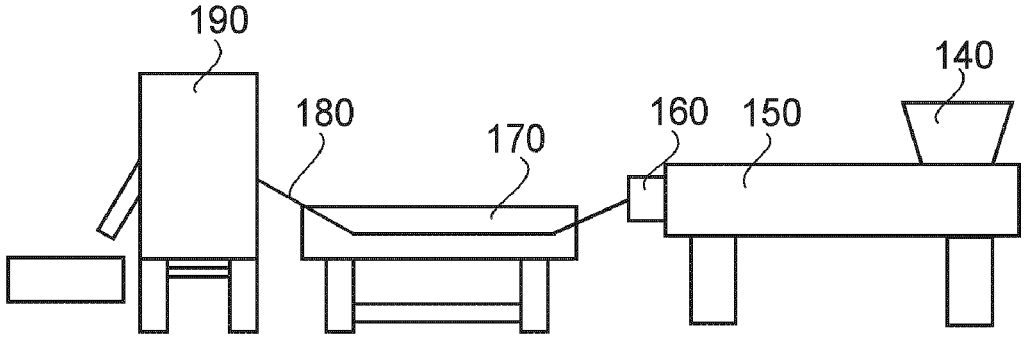
FIGS. 3 and 4 are schematic views each for illustrating a production process of a belt member.

(1) Referring to FIG. 3, 85 wt. parts of polyether ether ketone ("VICTREX PEED 450P", mfd. by Victrex plc) and 15 wt. parts of electroconductive carbon black (acetylene black, "DENKA BLACK", mfd. by DENKI KAGAKU KOGYO KABUSHIKI KAISHA) are supplied to a biaxial kneading extruder 150 and are kneaded at a cylinder temperature which is not less than a melting temperature of the resin material and is not more than a temperature not causing thermal degradation, specifically in a range from 340° C. to 40° C., thus being melt-extruded. This molten resin material is passed through a circular nozzle 160 by a so-called strand cut method to form a strand 180 in a diameter of 2 mm. The strand 180 is cooled with water at a cooling portion 170. Then, the strand 180 is cut into pellets each having a length of about 2 mm at a cutting portion 190, so that granular pellets with a size of 2 mm are prepared.

Figure 4:
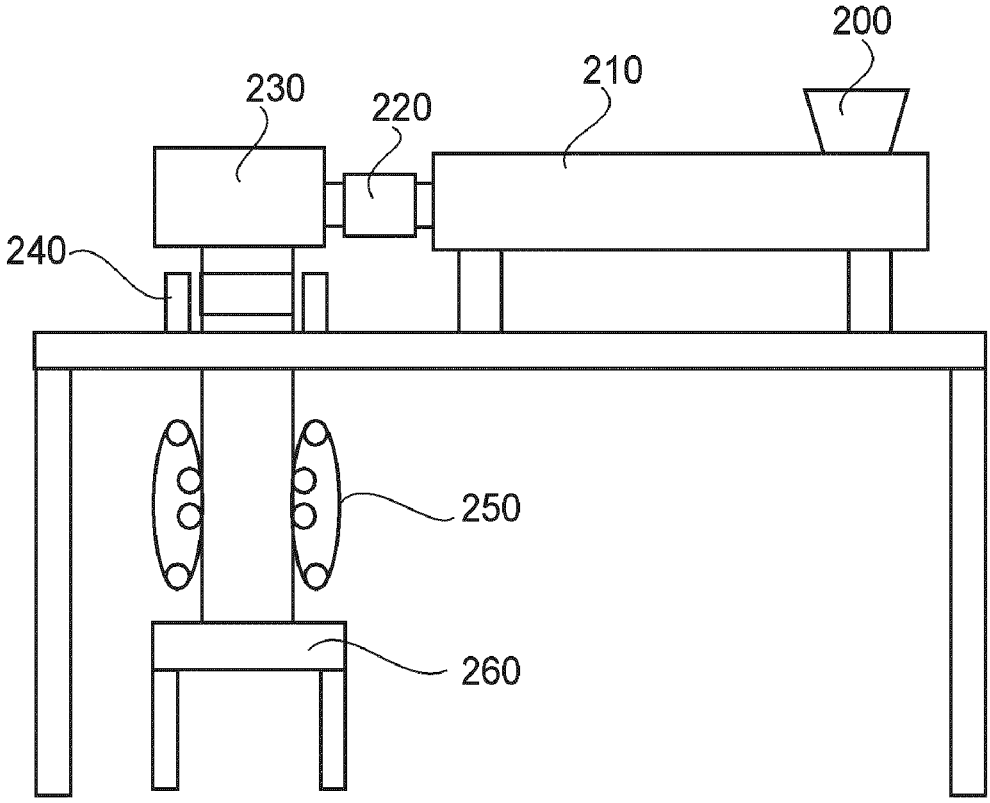
Figure 7:
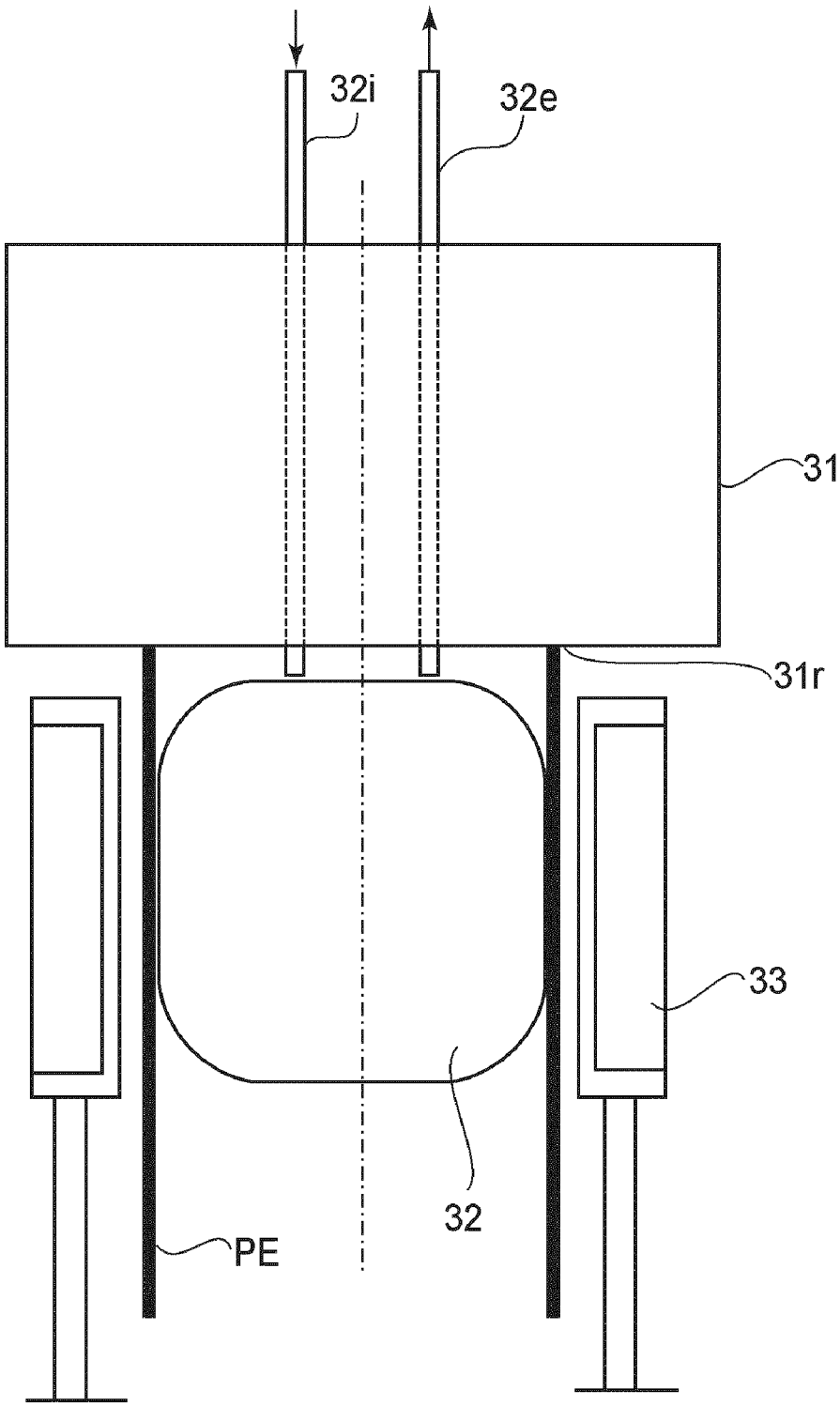
FIG. 7 is a schematic view for illustrating melt extrusion molding of a resinous belt material.

(2) By using these pellets in a belt production apparatus as shown in FIG. 4, a seamless belt is produced. Referring to FIG. 4, the belt production apparatus is constituted by a hopper 200, an extruder 210, a gear pump 220, a mold 230, a cooling device 240 as a feature of the present invention, a drawing device 250 for pulling a film in a cylindrical shape, and a cutting machine 260. First, the above-prepared pellets are charged into the hopper 200 and melt-extruded by the extruder 210. The extruder 210 is a single screw extruder set to a temperature of 340° C. to 400° C. similarly as in the case of the above-described extruder 150. The resultant molten resin material is ejected in constant amount through the gear pump 220, followed by melt-extrusion of the molten resin material in a tube-like shape by the mold 230 set at a transfer of 385° C. The mold 230 includes a spiral die in view of an occurrence of a weld line or the like and is warmed by winding a band heater around the mold 230. The resultant cylindrical molten resin material is melt-solidified by using the cooling device 240 as shown in FIG. 7 while being kept in the cylindrical shape and being pulled by using the drawing device 250.

(3) The cooling device will be described with reference to FIG. 7. While an inner surface of the tube in a molten state is brought into contact with a mandrel 32 set at a temperature of 90° C. to be quickly cooled, an outer surface of the tube is gradually cooled by using an external heating device 33 set at a temperature of 260° C., so that a degree of crystallinity of the resin material for the tube at the inner surface and that at the outer surface are controlled. Into the mandrel 32, an unshown heater and an unshown water-cooling device are incorporated, so that a temperature of a mirror-finished surface of the mandrel 32 formed of copper is arbitrarily settable in a range from a cooling water temperature to 300° C. A temperature-adjusted cooling water is supplied to a feed pipe 32*i* and is caused to circulate through a discharge pipe 32*e*, a constant temperature bath, a circulating pump, and the feed pipe 32*i*. Solidification and phase change of the molten resin material are effected so as to provide cooling processes for a front surface layer and a rear surface layer different from each other, so that a tube-like resinous belt member PE. The belt member passes through the cooling portion at a speed of 1 m/min.

(4) The cooled tube-like resinous belt member PE is cut by the cutting machine 260 so as to have a width of 400 mm and then is rubbed with a polishing film in a rotation state, thus being subjected to surface polishing to be mirror-finished.

(5) To each of both edge portions of the inner (peripheral) surface of the mirror-finished resinous belt member PE, a synthetic rubber plate with a thickness of 1 mm and a width of 5 mm is bonded in one full circumference of the belt member PE to form a rib (7*e*, 7*f* in FIG. 6) for preventing snaking.

As described above, in the present invention, immediately after the molten resin material is melt-extruded in the tube-like shape to be adjusted in thickness in the step (2), the degree of crystallinity described later is controlled by employing the cooling processes for the front surface layer and the rear surface layer different from each other.

Here, the hardness and the degree of crystallinity will be described. The crystalline resin material can be increased in degree of crystallinity by being cooled gradually, with the result that the hardness is increased. On the other hand, when the crystalline resin material is quickly cooled, the degree of crystallinity is decreased. As a result, the hardness is decreased.

Embodiments and Comparative Embodiments

Figure 8:
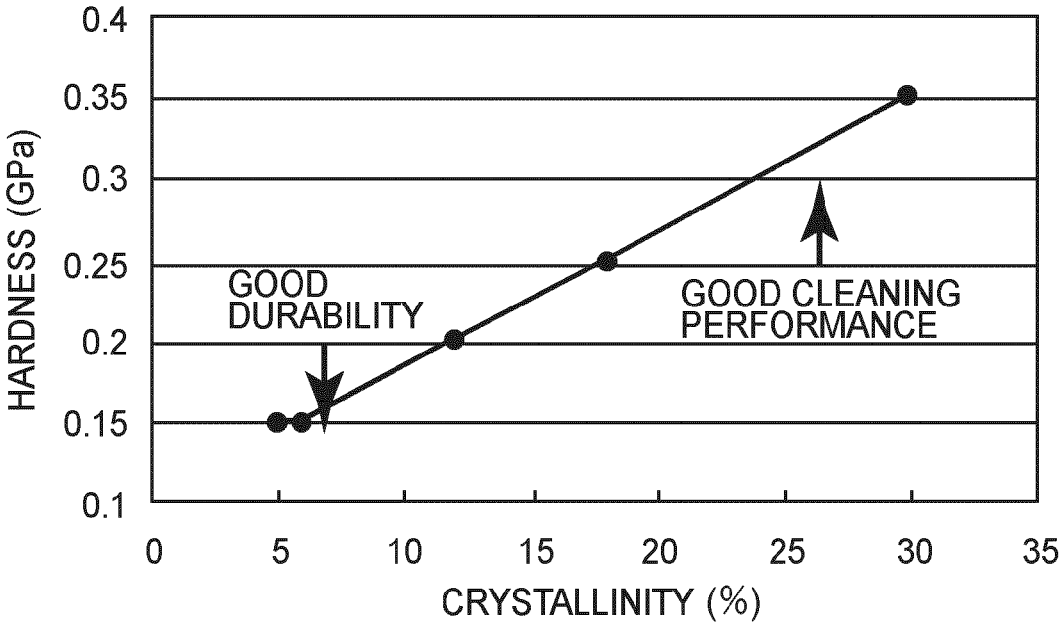
FIG. 8 is a graph for explaining practical ranges of surface hardness at a front surface and surface hardness at a rear surface.
Figure 9:
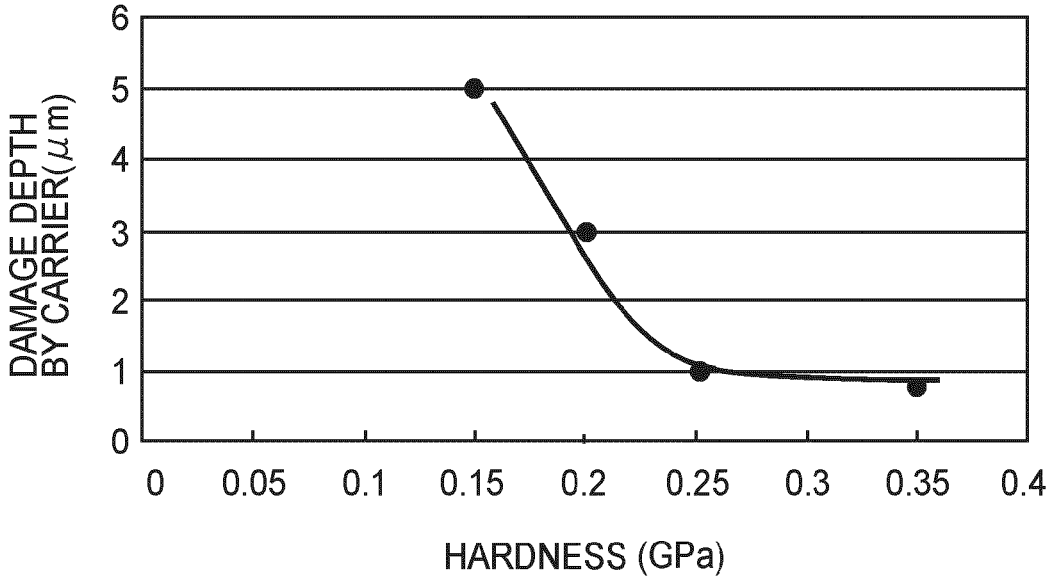
FIG. 9 is a graph showing a measurement result of a surface damage depth when the belt member is rubbed with the magnetic carrier.

FIG. 8 is a graph for illustrating a practical range of the surface hardness at the front surface (outer peripheral surface) and the rear surface (inner peripheral surface) and FIG. 9 is a graph for illustrating a measurement result of surface damage depth by rubbing with the magnetic carrier.

In Embodiments 1, 2, 3 and 4 and Comparative Embodiments 1, 2 and 3, intermediary transfer belts 8 different in degree of crystallinity as shown in Table 1 were formed by changing only temperature settings of cooling processes in the step (3) of the above-described production process as shown in Table 1.

In Embodiment 1, a temperature of the external heating device was set at 260° C. and a temperature of the mandrel was set at 90° C.

In Embodiment 2, the temperature of the external heating device was set at 130° C., so that a cooling speed at the inner surface was lowered compared with Embodiment 1.

In Embodiment 3, the temperature of the external heating device was set at 180° C., so that a cooling speed at the outer surface was increased compared with Embodiment 1.

In Embodiment 4, the temperature of the mandrel was set at 130° C. and the temperature of the external heating device was set at 180° C.

In Comparative Embodiment 1, the temperature of the mandrel was set at 260° C., so that the cooling speed at the inner surface was lowered compared with Embodiment 2.

In Comparative Embodiment 2, the temperature of the mandrel was se at 180° C., so that the cooling speed at the inner surface was lowered compared with Embodiment 2.

In Comparative Embodiment 3, the temperature of the mandrel was set at 180° C. and the temperature of the external heating device was set at 180° C.

In Comparative Embodiment 4, the temperature of the mandrel was set at 130° C. and the temperature of the external heating device was set at 130° C.

In Comparative Embodiment 5, the temperature of the mandrel was set at 90° C. and the temperature of the external heating device was se at 90° C.

TABLE 1

| | SET TEMP. (° C.) | | CRYSTALLINITY (%) | |
|---|---|---|---|---|
| DEVICE | HEATING (OUTER) | MANDREL (INNER) | FRONT | REAR |
| EMB. 1 | 260 | 90 | 30 | 6 |
| EMB. 2 | 260 | 130 | 30 | 12 |
| EMB. 3 | 180 | 90 | 18 | 5 |
| EMB. 4 | 180 | 130 | 18 | 12 |
| COMP. EMB. 1 | 260 | 260 | 30 | 30 |
| COMP. EMB. 2 | 260 | 180 | 30 | 18 |
| COMP. EMB. 3 | 180 | 180 | 18 | 18 |
| COMP. EMB. 4 | 130 | 130 | 12 | 12 |
| COMP. EMB. 5 | 90 | 90 | 6 | 6 |

The intermediary transfer belt 7 of Embodiment 1 was cut into two test pieces each having a size of 10 mm×10 mm. One test piece was bonded to a sample stage at its front surface as a bonding surface. The other test piece was bonded to the sample stage at its rear surface as the bonding surface. Each of the test pieces was shaved to have a thickness of 20 μm and set in an X-ray diffraction device (mfd. by Rigaku Corporation). An X-ray diffraction pattern of each of the test pieces was measured at a scanning speed of 5 degrees/min in a scanning range from 5 degrees of 45 degrees to calculate a degree of crystallinity.

The degree of crystallinity was calculated by using a so-called peak separation method in which the degree of crystallinity is determined by separating a peak at a crystalline portion and comparing a spectrum at an amorphous portion with a spectrum at the crystalline portion. With respect to polyether ether ketone, the peak at the crystalline portion was observed in the neighborhood of scanning angles of 18.6 degrees, 21 degrees, 22.8 degrees, and 28.8 degrees.

As shown in Table 1, in Embodiment 1, the degree of crystallinity at the gradually cooled front surface was 30%, while the degree of crystallinity at the quickly cooled rear surface was 6%.

In Embodiment 2, the degree of crystallinity at the gradually cooled front surface was 30%, while the degree of crystallinity at the rear surface slowly cooled compared with Embodiment 1 was 12%.

In FIG. 3, the degree of crystallinity at the front surface cooled fast compared with Embodiment 1 was 18%, while the degree of crystallinity at the quickly cooled rear surface was 5%.

In Embodiment 4, the degree of crystallinity at the front surface cooled fast compared with Embodiment 1 was 18%, while the degree of crystallinity at the rear surface slowly cooled compared with Embodiment 1 was 12%.

In Comparative Embodiment 1, the degree of crystallinity at the gradually cooled front surface was 30%, while the degree of crystallinity at the rear surface slowly cooled compared with Embodiment 2 was 30%.

In Comparative Embodiment 2, the degree of crystallinity at the gradually cooled front surface was 30%, while the degree of crystallinity at the rear surface slowly cooled compared with Embodiment 2 was 18%.

In Comparative Embodiment 3, the degree of crystallinity at the front surface cooled fast compared with Embodiment 1 was 18%, while the degree of crystallinity at the rear surface slowly cooled compared with Embodiment 2 was 18%.

In Comparative Embodiment 4, the degree of crystallinity at the front surface cooled fast compared with Embodiment 1 was 12%, while the degree of crystallinity at the rear surface cooled similarly as in Embodiment 2 was 12%.

In Comparative Embodiment 5, the degree of crystallinity at the front surface cooled fast compared with Embodiment 1 was 6%, while the degree of crystallinity at the rear surface cooled similarly as in Embodiment 3 was 6%.

Each of the intermediary transfer belts 7 was cut into two test pieces, which were subjected to measurement of the surface hardness at the front surface and the rear surface according to a continuous stiffness measurement method by using an ultramicro-hardness meter ("Nano Indenter", mfd. by MTI Systems Corporation). An indenter used is a diamond indenter having such a triangular-pyramid-like shape that an angle between adjacent edge lines of triangular sides if 115 degrees, i.e., a so-called Berkovich indenter. Measurement was performed until a depth reached 2.0 μm under a condition including an oscillation frequency of 45H2 and a target value of displacement amplitude of 1 nm. The measurement was performed 10 times while a measuring point was changed. An average of measured ten points was employed as a surface hardness value. The result of measurement is shown in Table 2.

TABLE 2

| | DEGREE OF CRYSTALLINITY (%) | | SURFACE HARDNESS (GPa) | |
|---|---|---|---|---|
| | FRONT | REAR | FRONT | REAR |
| EMB. 1 | 30 | 6 | 0.35 | 0.15 |
| EMB. 2 | 30 | 12 | 0.35 | 0.2 |
| EMB. 3 | 18 | 5 | 0.25 | 0.15 |

TABLE 2-continued

| | DEGREE OF CRYSTALLINITY (%) | | SURFACE HARDNESS (GPa) | |
|---|---|---|---|---|
| | FRONT | REAR | FRONT | REAR |
| EMB. 4 | 18 | 12 | 0.25 | 0.2 |
| COMP. EMB. 1 | 30 | 30 | 0.35 | 0.35 |
| COMP. EMB. 2 | 30 | 18 | 0.35 | 0.25 |
| COMP. EMB. 3 | 18 | 18 | 0.25 | 0.25 |
| COMP. EMB. 4 | 12 | 12 | 0.2 | 0.2 |
| COMP. EMB. 5 | 6 | 6 | 0.15 | 0.15 |

As shown in Table 2, in Embodiment 1, the surface hardness of the intermediary transfer belt 7 was 0.35 GPa at the front surface and 0.15 GPa at the rear surface.

In Embodiments 2 to 4 and Comparative Embodiments 1 to 5, the surface hardnesses of the intermediary transfer belt 7 were those substantially corresponding to the values of the degree of crystallinity at the front surface and the rear surface.

Then, each of the intermediary transfer belts 7 of Embodiments 1 to 4 and Comparative Embodiments 1 to 5 was mounted in the image forming apparatus 100 as shown in FIG. 1 and was subjected to image formation an $30\times10^4$ sheets of plain paper.

Status of an occurrence of a crack and status of an occurrence of a cleaning failure are shown in Table 3.

TABLE 3

| | DEGREE OF CRYSTALLINITY(%) | | | CLEANING |
|---|---|---|---|---|
| | FRONT | REAR | CRACK | FAILURE |
| EMB. 1 | 30 | 6 | Not occurred | Not occurred |
| EMB. 2 | 30 | 12 | Not occurred | Not occurred |
| EMB. 3 | 18 | 5 | Not occurred | Not occurred |
| EMB. 4 | 18 | 12 | Not occurred | Not occurred |
| COMP. EMB. 1 | 30 | 30 | occurred at $1\times10^4$ sheets | Not occurred |
| COMP. EMB. 2 | 30 | 18 | Occurred at $10\times10^4$ sheets | Not occurred |
| COMP. EMB. 3 | 18 | 18 | Occurred at $10\times10^4$ sheets | Not |
| COMP. EMB. 4 | 12 | 12 | Not occurred | Occurred at $20\times10^4$ sheets |
| COMP. EMB. 5 | 6 | 6 | Not occurred | Occurred at $5\times10^4$ sheets |

Further, it was confirmed that the intermediary transfer belt 7 of Embodiment 1 caused no occurrence of a crack and no occurrence of a cleaning failure through an experiment of image formation on $300\times10^4$ sheets. As a result, even in the case of the image formation on $30\times10^4$ sheets, compared with the conventional intermediary transfer belts 7 each formed in a layer structure of polyether ether ketone, the intermediary transfer belt 7 of Embodiment 1 was improved in size and depth of scratches caused by ferrite of the magnetic carrier, magnetic powder in ambient air, the inorganic fine particles, and the like. Further, in Embodiments 1 to 4, there was no lowering in cleaning performance with respect to the toner, so that the transfer residual toner was completely removed from the intermediary transfer belts 7 by the cleaning blade (19*b* shown in FIG. 1).

Each of the intermediary transfer belts 7 of Embodiment 1 to 4 is formed of polyether ether ketone in a layer. Further, the degree of crystallinity at the front surface (outer surface) is 16% or more and the surface hardness at the front surface (outer surface) is 0.25 GPa or more. The degree of crystallinity at the rear surface (inner surface) is 12% or less and the surface hardness at the rear surface (inner surface) is 0.20 GPa or less. In such a constitution, there were no occurrence of a crack and no occurrence of a cleaning failure in the image formation on $30\times10^4$ sheets.

Each of the intermediary transfer belts 7 of Comparative Embodiments 1 to 3 is formed of polyether ether ketone in a layer. However, the degree of crystallinity at the rear surface (inner surface) is not 12% or less and the surface hardness at the rear surface (inner surface) is not 0.20 GPa or less. In such a constitution, the crack occurs when the number of image formed sheets reaches $30\times10^4$ sheets.

Each of the intermediary transfer belts 7 of Comparative Embodiments 4 and 5 is formed of polyether ether ketone in a layer. However, the degree of crystallinity at the front surface (outer surface) is not 16% or more and the surface hardness at the front surface (outer surface) is not 0.25 GPa or more. In such a constitution, the cleaning failure occurs when the number of image formed sheets reaches $30\times10^4$ sheets.

A relationship between the surface hardnesses at the front surface and the rear surface and the occurrences of cracks and cleaning failures are shown in Table 4.

TABLE 4

| REAR SURFACE | FRONT SURFACE HARDNESS (GPa) | | |
|---|---|---|---|
| HARDNESS (GPa) | 0.35 | 0.25 | 0.15 |
| 0.35 | C1*1 | — | — |
| 0.25 | B*2 | B*2 | — |
| 0.2 | A*3 | A*3 | — |
| 0.15 | A*3 | A*3 | C2*4 |

C1*1: Crack occurred at $1\times10^4$ sheets.
B*2: Crack occurred at $10\times10^4$ sheets.
A*3: Crack and cleaning failure did not occur at $30\times10^4$ sheets.
C2*4: Cleaning failure occurred at $5\times10^4$ sheets.

As shown in FIG. 8, the surface hardnesses of the intermediary transfer belts 7 of Embodiments 1 to 4 and Comparative Embodiments 1 to 5 provide a linear distribution with respect to the values of the degree of crystallinity of polyether ether ketone (PEEK).

In the image forming apparatus 100 of First Embodiment, with respect to the surface hardness at the front surface (outer surface), the practical range is 0.25 GPa or more. This is because when the surface hardness at the front surface is less than 0.25 GPa, the size and depth of scratches caused by ferrite of the magnetic carrier, the magnetic power in ambient air, the inorganic fine particles, and the like are out of a tolerable range to result in excessive change in glossiness or surface roughness due to cumulative image formation. Further, that is because the surface hardnesses causing the occurrence of the cleaning failure phenomenon in the image formation on less than $30\times10^4$ sheets are less than 0.25 GPa as shown in Tables 3 and 4.

Further, with respect to the surface hardness at the inner surface, i.e., the rear surface hardness, the practical range is 0.25 GPa or less. This is because when the rear surface hardness exceeds 0.20 GPa, the material for the intermediary transfer belt becomes brittle to have insufficient anti-fatigue strength and insufficient anti-flexing strength. Further, that is because the rear surface hardnesses causing the occurrence of a crack exceed 0.20 GPa as shown in Tables 3 and 4.

In the image forming apparatus 100, when the degree of crystallinity at the front surface of the intermediary transfer belt 7 is 16% or more, the front surface hardness is 0.25 GPa or more, thus satisfying a good function with respect to a surface property.

Further, when the degree of crystallinity at the inner surface is 12% or less, the rear surface hardness is 0.20 GPa or less, thus satisfying good durability.

Next, in order to confirm and study the surface property, a shortened experiment regarding the surface property of the intermediary transfer belts 7 of Embodiments 1 to 4 and Comparative Embodiments 1 to by using the image forming apparatus 100 shown in FIG. 1 was conducted.

Specifically, between the photosensitive drum 1*d* and each of the intermediary transfer belts 7, a magnetic carrier produced by mixing a magnetic metal oxide and a non-magnetic metal oxide in a phenolic binder resin material and subjecting the mixture to a polymerization method was forcedly supplied. Then, in a rest state of the intermediary transfer belt 7, the photosensitive drum 1*d* was rotationally driven. Then, a surface damage depth formed on the intermediary transfer belt 7 by rubbing with the magnetic carrier was measured through a laser microscope ("VK-8500", mfd. by KEYENCE CORPORATION).

As shown in FIG. 9, the front surface hardness and the surface damage depth by the magnetic carrier correlated with each other. That is, with a higher surface hardness, the surface damage depth of the intermediary transfer belt 7 was less. This can be considered because the intermediary transfer belt 7 passing through the primary transfer portion T1 is largely deformed plastically in the case where the front surface hardness is low but the intermediary transfer belt 7 is not plastically deformed in the case where the front surface hardness is higher than "0.25 GPa as a boundary value".

Accordingly, with respect to the intermediary transfer belts 7 having the front surface hardness of 0.25 GPa or more, even when the surface of the intermediary transfer belt 7 is damaged, the damage is less. For this reason, in the image forming apparatus 100, a good cleaning property and a good image characteristic are ensured.

With respect to the crack of the intermediary transfer belt 7, in the case where the degree of crystallinity was increased by gradually cooling the entire tube placed in the molten state, the resin material itself has brittleness. Due to the brittleness, the crack occurred with respect to local deformation in the neighborhood of the ribs (7*e*, 7*f* in FIG. 6).

In Embodiments 1 to 4, only the front surface is increased in degree of crystallinity, so that the front surface exhibits the brittleness but a portion from a center to the rear surface has the hardness, i.e., is amorphous. Therefore, the entire thickness portion has tenacity to some extent. For this reason, even in the case of the local deformation, the belt has flexibility, so that it is considered that the crack did not occur.

Incidentally, with respect to the front surface hardness, when the front surface hardness exceeded 0.40 GPa, the photosensitive drum rubbing against the belt surface having the high hardness was largely influenced. For that reason, an upper limit of the front surface hardness is 0.40 GPa or less. For less influence on the photosensitive drum, it is preferable that the front surface hardness is 0.35 GPa or less.

Further, with respect to the rear surface hardness, when the rear surface hardness is less than 0.10 GPa, the following problem arises. That is, the rear surface of the belt member is constituted so as to rub against the stretching members (rollers or the like) for stretching the belt member. When the hardness is excessively lowered, by the rubbing between the rear surface and the stretching members, a degree of abrasion of the front surface is extremely increased, thus shortening the lifetime of the belt member. For that reason, the rear surface hardness is required to be 0.10 GPa or more.

Further, in First Embodiment, the tandem type image forming apparatus is described but the intermediary transfer belts 7 of Embodiments 1 to 4 can also be used in one (single) drum type image forming apparatus in which a photosensitive drum provided with a plurality of developing devices is brought into contact with the intermediary transfer belt.

The intermediary transfer belts 7 of Embodiments 1 to 4 can be used as not only the intermediary transfer belt but also a recording material conveyance belt for conveying the recording material.

As the crystalline thermoplastic resin material usable for the intermediary transfer belt 7, any resin material is usable if it can satisfy the above-described electrical and mechanical performances.

With respect to polyether ether ketone, polyphenylene sulfide, and polybutylene terephthalate, it was possible to obtain a practical intermediary transfer belt having different degrees of crystallinity at the front surface and the rear surface. Further, it is considered that polyethylene terephthalate, polyethylene, polypropylene, polyamide, and the like may suitably be used.

Further, to these resin materials, for the purpose of imparting electroconductivity, at least one species of organic or inorganic fine powder may be added. For example, it is possible to use inorganic spherical fine particles such as carbon black power, magnesium oxide powder, magnesium fluoride powder, silicon oxide powder, aluminum oxide powder, boron nitride powder, aluminum nitride powder, and titanium oxide powder. The fine powder may preferably be spherical particles and may preferably have a particle size of 1.0 μm or less in order to retain surface smoothness of the resin material to which the fine powder is added.

The kind, the particle size and the content of such fine powder to be added are determined so as to ensure electroconductivity necessary for a base layer. However, a total amount of the addition of such fine powders may preferably be about 5-40 wt. %, particularly 5-25 wt. %, on the basis of a base resin material.

In FIGS. 1 to 4, the thermoplastic resin material is used but it is also possible to a thermosetting resin material. In this case, the degree of crystallinity is controlled by adjusting a condition during the heating to provide the front surface hardness and the rear surface hardness falling within the above ranges, so that a similar effect can be achieved.

Incidentally, the conventional image forming apparatus has employed the intermediary transfer belt having the single layer structure using the polyimide resin material as described in JP-A 2001-047451. This is because the polyimide resin material has high elastic modulus and is excellent in various characteristics such as heat resistance, the anti-wearing property, and creep resistance. However, the polyimide resin material is the thermosetting resin material, so that melt extrusion thereof is impossible and it is also difficult to adjust the thickness. As a result, great production cost is required.

Further, the conventional image forming apparatus has employed the intermediary transfer belt having a plural layer structure in which a rubber elastic layer is formed on a thin metal plate layer as described in JP-A 2000-330390. However, the intermediary transfer belt having the plural layer structure is increased in the number of steps including lamination, coating, thickness adjustment, etc., so that production cost greater than the case of the single layer structure of the polyimide resin material is required.

For these reasons, in a small-size image forming apparatus with use frequency which is not so high, the intermediary transfer belt, using the thermoplastic resin material, capable of being produced at lower cost has been required.

In the above-described JP-A 2005-112942, the intermediary transfer belt using polyether ether ketone (PEEK) as an example of the crystalline thermoplastic resin material is described. Polyether ether ketone is inferior to the polyimide resin material but is excellent in chemical resistance, the anti-fatigue property, toughness, the anti-wearing property, slidability, heat resistance (creep characteristic at 70° C.) and has high elastic modulus at high temperature and is also excellent in shock resistance and flex resistance. Polyether ether ketone is the thermoplastic resin material, so that it is possible to adopt a production process, which is continuous and has high productivity, such as the melt extrusion, extension thickness adjustment, or the like. Polyether ether ketone is a crystalline polymer but its degree of crystallinity can be properly suppressed by design of a molecular structure, thus also having a characteristic as an amorphous polymer.

The crystalline thermoplastic resin material capable of being utilized for the intermediary transfer belt is not limited to polyether ether ketone. JP-A 2006-069046 describes an intermediary transfer belt using polyphenylene sulfide (PPS) as an example of the crystalline thermoplastic resin material.

A part of the crystalline thermoplastic resin material including polyether ether ketone is excellent in both of mechanical strength and processing property as used in mechanical parts as engineering plastics.

However, when such a resin material was used actually in the image forming apparatus after being processed in the intermediary transfer belt having the seamless layer structure, compared with the polyimide resin material as in Comparative Embodiment 5, the anti-wearing property and the slidability were insufficient, with the result that an early lowering in surface glossiness and an early deterioration in surface roughness by cumulative image formation were confirmed.

Therefore, as in Comparative Embodiment 1, it was studied that the anti-wearing property and the slidability were ensured by gradually cooling the entire resin material during the melt extrusion to enhance the degree of crystallinity thereby to increase the front surface hardness.

However, when the degree of crystallinity of the entire resin material was enhanced to such a degree that a necessary anti-wearing property was ensured as in Comparative Embodiment 1, it was found that an anti-fatigue strength, flexibility, and an anti-flexing strength were lowered to shorten an exchange lifetime of the belt member. When the belt member was continuously rotated in a low temperature environment under high tension in a state in which ribs for limiting movement of the belt member in an axial direction were provided at both edge portions of the inner peripheral surface of the belt member so as to extend continuously along one full circumference of the belt member, it was found that the crack was liable to occur at a base boundary portion of the projected ribs.

On the other hand, in Embodiments 1 to 4, particularly in Embodiment 1, only the surface layer at the outer peripheral surface of the intermediary transfer belt subjected to rubbing with the magnetic carrier is increased in degree of crystallinity, so that the anti-wearing property and the anti-rubbing property of the intermediary transfer belt are enhanced.

Further, a portion from a center layer to the inner peripheral surface of the intermediary transfer belt principally contributing to tension and a flexing force is kept in a high amorphous texture state to avoid stress concentration at grain boundary, so that the anti-fatigue strength, the flexibility, and the anti-flexing strength of the intermediary transfer belt are ensured.

Accordingly, it was possible to enhance the anti-wearing property and the anti-rubbing property at the front surface of the intermediary transfer belt without impairing the anti-fatigue strength, the flexibility, and the anti-flexing strength of the intermediary transfer belt formed in the seamless layer by using the thermoplastic resin material.

Embodiments 1 to 4, particularly Embodiment 1 realizes the intermediary transfer belt increased in anti-wearing property and anti-rubbing property while ensuring the anti-fatigue strength and the anti-flexing strength of the intermediary transfer belt formed in the layer by using the thermoplastic resin material. The image forming apparatus including the intermediary transfer belt with cost lower than that of the single layer structure of the polyimide resin material is realized. The intermediary transfer belt which is produced at a lower cost than that of the polyimide single layer structure and has the layer structure, with low cost and long exchange lifetime, capable of adequately ensuring the mechanical lifetime and a quality lifetime, is provided. The image forming apparatus 100 including the low-cost intermediary transfer belt ensuring the adequate performances is provided.

Figure 10:
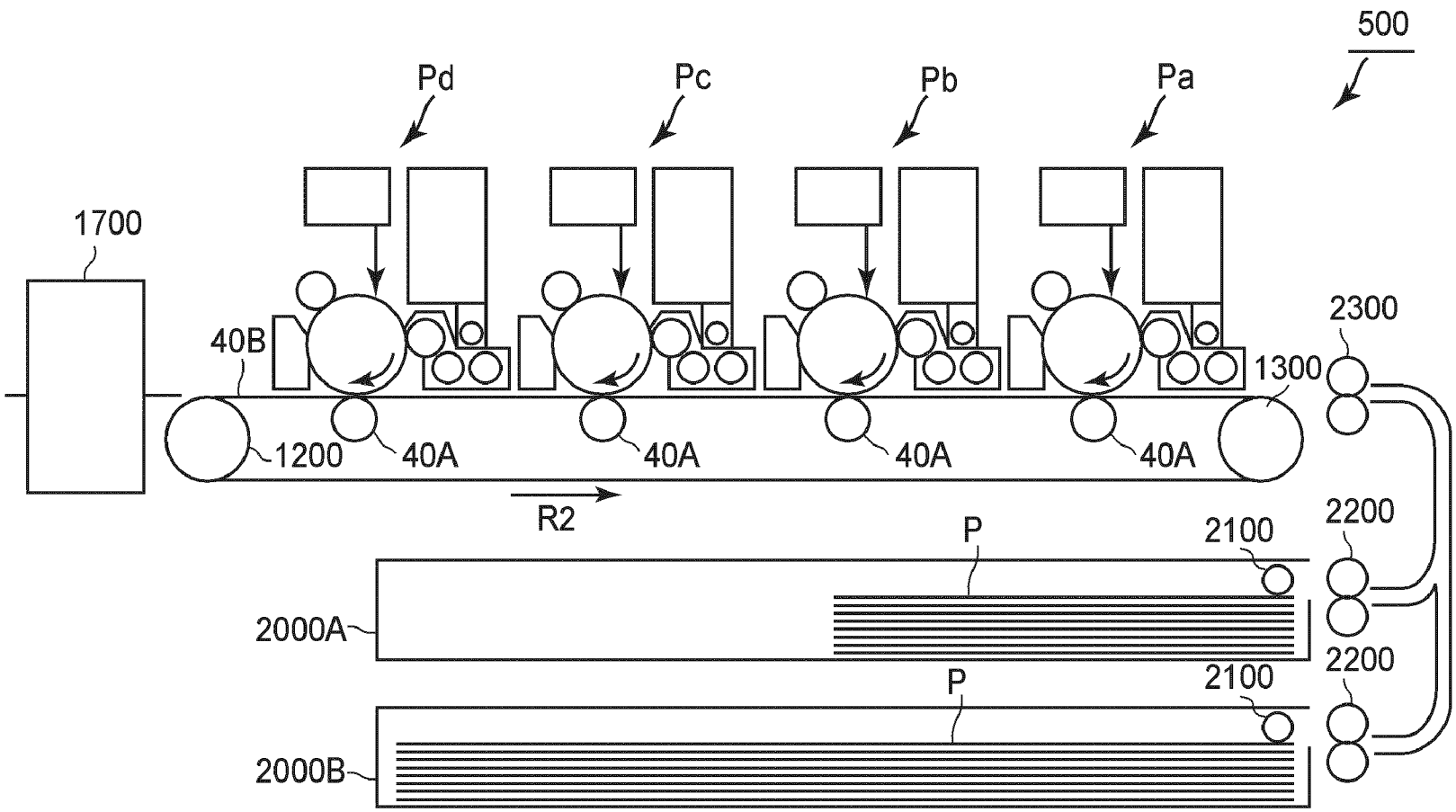
FIG. 10 is a schematic view of an image forming apparatus using a recording material conveyer belt.

Incidentally, numerical limitation such that the front surface hardness is 0.25 GPa or more, as shown in FIG. 9, refers to a boundary value before rubbing damage by the magnetic carrier is abruptly increased. In the above description, the belt member is used in the form of the intermediary transfer belt. However, the belt member according to the present invention may also be used as the recording material conveyance belt for conveying the recording material. Specifically, as shown in FIG. 10, a recording material conveyance belt 40B adsorbs and conveys a recording material P delivered from registration rollers 2300 and is passed successively through image forming stations Pa, Pb, Pc and Pd. In the image forming station Pa, a yellow toner image is formed and transferred onto the recording material and then in the image forming station Pb, a magenta toner image is formed and transferred onto the yellow toner image on the recording material P in a superposition manner. In the image forming station Pc and Pd, a cyan toner image and a black toner image are formed, respectively, and are successively transferred onto a previously transferred toner image on the recording material P in the superposition manner.

The recording material P on which the four color toner images are transferred is heated and pressed by a fixing device 1700 to have fixed toner images on its surface and thereafter is discharged to the outside of an image forming apparatus 500. Even when the belt member of the present invention is used in such an image forming apparatus, it is possible to achieve the effect of the present invention.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 232921/2007 filed Sep. 7, 2007, which is hereby incorporated by reference.

What is claimed is:

1. A belt member to be rotatably extended around a plurality of rotatable members of an image forming apparatus for forming a toner image on a recording material by using a developer containing a magnetic carrier, said belt member comprising:

a layer, formed of a crystalline resin material, having an outer peripheral surface and an inner peripheral surface, wherein said layer has a hardness of 0.25 GPa or more and 0.40 GPa or less at the outer peripheral surface and a hardness of 0.10 GPa or more and 0.20 GPa or less at the inner peripheral surface.

2. A member according to claim 1, wherein said crystalline resin material of said layer at the outer peripheral surface has a degree of crystallinity higher than that of said crystalline resin material of said layer at the inner peripheral surface.

3. A member according to claim 1, wherein said crystalline resin material is a thermoplastic resin material.

4. A member according to claim 1, wherein said belt member is provided with inwardly projected ribs, for limiting movement of said belt member in a rotational axis direction, extending continuously along a full circumference of said belt member, at both side portions of the inner peripheral surface.

5. A member according to claim 1, wherein said crystalline resin material is polybutylene terephthalate, polyphenylene sulfide, or polyether ether ketone.

6. A member according to claim 1, wherein said layer is formed of polyether ether ketone and has a degree of crystallinity of 16% or more at the outer peripheral surface and a degree of crystallinity of 12% or less at the inner peripheral surface.

7. A member according to claim 1, wherein said belt member is an intermediary transfer belt for carrying a toner image.

8. An image forming apparatus for forming a toner image on a recording material by using a developer containing a magnetic carrier, said apparatus comprising:

an image forming station for forming a toner image; and a belt member having a layer, formed of a crystalline resin material, which has an outer peripheral surface and an inner peripheral surface, wherein said layer has a hardness of 0.25 GPa or more and 0.40 GPa or less at the outer peripheral surface and a hardness of 0.10 GPa or more and 0.20 GPa or less at the inner peripheral surface.

9. An apparatus according to claim 8, wherein said crystalline resin material of said layer at the outer peripheral surface has a degree of crystallinity higher than that of said crystalline resin material of said layer at the inner peripheral surface.

10. An apparatus according to claim 8, wherein said crystalline resin material is a thermoplastic resin material.

11. An apparatus according to claim 8, wherein said belt member is provided with inwardly projected ribs, for limiting movement of said belt member in a rotational axis direction, extending continuously along a full circumference of said belt member, at both side portions of the inner peripheral surface.

12. An apparatus according to claim 8, wherein said crystalline resin material is polybutylene terephthalate, polyphenylene sulfide, or polyether ether ketone.

13. An apparatus according to claim 8, wherein said layer is formed of polyether ether ketone and has a degree of crystallinity of 16% or more at the outer peripheral surface and a degree of crystallinity of 12% or less at the inner peripheral surface.

14. An image forming apparatus for forming a toner image on a recording material by using a developer containing a magnetic carrier, said apparatus comprising:

an image forming station for forming a toner image; and a belt member for conveying a recording material onto which the toner image is transferred from said image forming station, said belt member having a layer, formed of a crystalline resin material, which has an outer peripheral surface and an inner peripheral surface, wherein said layer has a hardness of 0.25 GPa or more and 0.40 GPa or less at the outer peripheral surface and a hardness of 0.10 GPa or more and 0.20 GPa or less at the inner peripheral surface.

15. An apparatus according to claim 14, wherein said crystalline resin material of said layer at the outer peripheral surface has a degree of crystallinity higher than that of said crystalline resin material of said layer at the inner peripheral surface.

16. An apparatus according to claim 14, wherein said crystalline resin material is a thermoplastic resin material.

17. An apparatus according to claim 14, wherein said belt member is provided with inwardly projected ribs, for limiting movement of said belt member in a rotational axis direction, extending continuously along a full circumference of said belt member, at both side portions of the inner peripheral surface.

18. An apparatus according to claim 14, wherein said crystalline resin material is polybutylene terephthalate, polyphenylene sulfide, or polyether ether ketone.

19. An apparatus according to claim 14, wherein said layer is formed of polyether ether ketone and has a degree of crystallinity of 16% or more at the outer peripheral surface and a degree of crystallinity of 12% or less at the inner peripheral surface.

* * * * *